United States Patent [19]

Duester et al.

[11] 4,007,861

[45] Feb. 15, 1977

[54] HANGER CONNECTOR

[75] Inventors: Everett L. Duester, Holland; Judd F. Garrison, Grand Rapids, both of Mich.

[73] Assignee: John Thomas Batts, Inc., Zeeland, Mich.

[22] Filed: Dec. 24, 1975

[21] Appl. No.: 644,118

[52] U.S. Cl. ..... 223/85; 211/113

[51] Int. Cl.[2] ..... A47J 51/084

[58] Field of Search ..... 223/85, 87, 88, 92, 223/84; 211/113; 248/248

[56] References Cited

UNITED STATES PATENTS

| | | | |
|---|---|---|---|
| 1,863,216 | 6/1932 | Wordingham | 223/DIG. 1 |
| 2,753,143 | 7/1956 | Berlt | 223/DIG. 1 |
| 2,998,172 | 8/1961 | Stefano | 223/88 |
| 3,244,334 | 4/1966 | Marlar | 223/87 X |

*Primary Examiner*—George H. Krizmanich
*Attorney, Agent, or Firm*—Price, Heneveld, Huizenga & Cooper

[57] ABSTRACT

A connector for supporting one hook suspended garment hanger from another in a vertically spaced relationship, takes the form of an elongated strip of flexible, sheet-like material having tension sustaining characteristics. The upper quarter of the connector includes an opening for receiving the hook of the upper one of the hangers. The lower portion of the connector includes a pair of spaced, parallel, longitudinally extending slits thereby defining a strap for attachment of the hook of the lower one of the hangers.

3 Claims, 4 Drawing Figures

HANGER CONNECTOR

BACKGROUND OF THE INVENTION

This invention relates to display arrangements and, more particularly, to display arrangements for hangers of the hook suspended variety.

In the display of clothes and other garments, it is common practice to employ a hook suspended hanger upon which the garments are placed and thereby suspended from a rack or other pole-like arrangement. In the display of suits, blouses, skirts, shirts, and other color coordinated or functionally related clothing, it is highly desirable that they be presented to a customer in a manner whereby the color coordination or functional relationship may be readily observed. For example, it would be desirable to display a sport coat or jacket along with a variety of slacks or skirts in a manner whereby the color coordination would be readily apparent. One such manner of display would be to employ a multiple tier, one-piece hanger whereby the jacket would surround vertically spaced slacks.

Heretofore, such display arrangements required special hanger constructions. A need, therefore, exists for an inexpensive, easily manufactured, detachable and reusable device for supporting one hook suspended garment hanger of conventional design from another in a vertically spaced relationship.

SUMMARY OF THE INVENTION

In accordance with the present invention, a unique, inexpensive, detachable and reusable device is provided for supporting one hook suspended garment hanger from another in vertically spaced relationship. Essentially, the device includes an elongated strip of flexible, sheet-like material having tension sustaining characteristics. An opening is formed in the device adjacent one end for receiving the hook of suspended upper hook suspended garment hanger. Spaced, parallel, longitudinally extending slits are included in the lower portion of the strip material to define a strap spaced from both sides of the device. The strap provides a point of attachment for the hook of the lower one of the hangers whereby a pair of hook sjuspended garment hangers may be supported and spaced in a vertical relationship.

DETAILED DESCRIPTION OF THE PREFERRED EMBODIMENT

Figure 1:
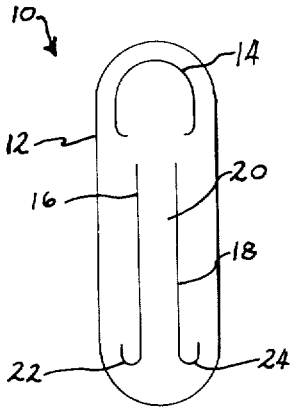
FIG. 1 is a front, elevational view of a hanger connector in accordance with the present invention.
Figure 2:
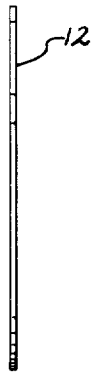
FIG. 2 is a side, elevational view of the hanger connector of FIG. 1.

The unique hanger connector in accordance with the present invention is illustrated in FIGS. 1 and 2 and generally designated 10. As shown therein, the connector 10 includes an elongated strip of flexible, sheet-like material 12. The strip 12 is shown as including elongated, spaced parallel edges and rounded ends. Formed in the upper portion of the strip 12 adjacent the top end is a generally inverted, U-shaped slit 14. The slit 14 defines a flap covered opening dimensioned so as to readily receive the hook of a hook suspended garment hanger, as will be more fully described below. The slit 14 extends both transversely and longitudinally of the strip 12.

Extending longitudinally of the lower portion of the strip 12 are a pair of spaced, parallel slits 16, 18. The slits, therefore, define a strap 20 which is spaced from the lateral edges of the elongated strip 12. This strap 20 provides a ready attachment point for a second hook suspended garment hanger.

As shown in FIG. 1, the lower ends of the slits 16, 18 may be extended outwardly and upwardly in a hook-like shape 22, 24, rspectively. As a result, the slits 16, 18 could be defined as generally U-shaped slits having one greatly elongated leg. The upturned portions 22, 24 are provided to increase the resistance of the connector to tearing along the slit lines when a second hanger is suspended therefrom.

Figure 4:
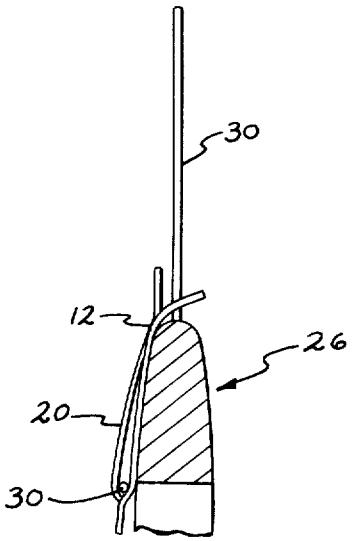
FIG. 4 is a partial, cross sectional, side elevational view taken generally along line IV—IV of FIG. 3.
Figure 3:
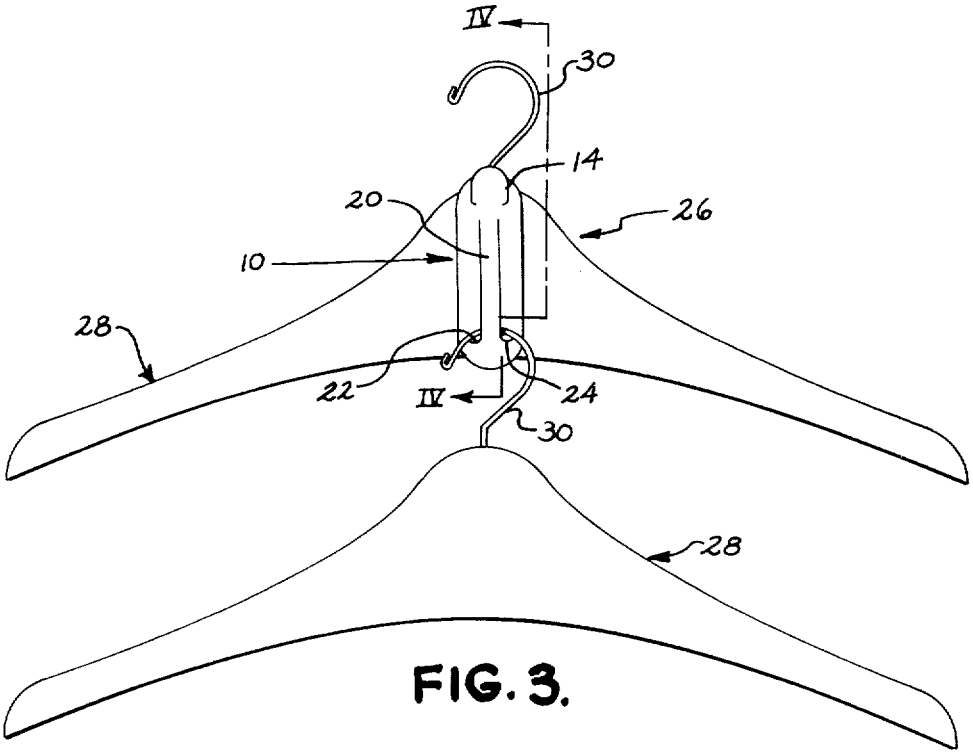
FIG. 3 is a front, elevational view showing the manner in which the connector of FIGS. 1 and 2 may be employed to support hook suspended garment hangers in a spaced vertical relationship.

The manner in which the unique hanger connector in accordance with the present invention is employed to support one hook suspended garment hanger from another in a vertically spaced relationship is shown in FIGS. 3 and 4. As shown therein, an upper hanger 26 may support a lower hanger 28 through the connector 10. Each hanger 26, 28 includes a hook 30. The hook 30 of the upper hanger 26 is readily insertable through the opening formed by the slit 14 in the upper portion of the connector. The hook 30 of the lower hanger 28 may then be woven through the slits 16, 18 and therefore be retained between the strap 20 and a strip of sheet-like material 12. The hook 30 is readily received within the upturned end portions 22, 24 of the slits 16, 18. In this way, the downward or tension force exerted on the connector is spread over a larger area of the strip of flexible sheet-like material and the force concentration characteristic of the end of a simple cut is eliminated. This feature, therefore, reduces the chance of tearing of the connector by the force imposed thereon when a garment is placed on the lower hanger 28. As shown in FIG. 4, since the strip 12 is flexible, it readily conforms to the shape of the hanger 26 and the lower hanger 28 is suspended therefrom in a laterally and vertically spaced relationship. It has been found that strips 12 die cut from 0.020 inches thick polypropylene sheet have excellent functional characteristics for use in the retail clothing industry.

As is now apparent, the hanger connector in accordance with the present invention greatly simplifies the manner in which various color coordinated or functionally coordinated garments or other such articles may be displayed together. The connector may be inexpensively manufactured in great quantities through a simple die cutting operation from plastic sheet material. The material employed preferably is somewhat flexible and has sufficient tension sustaining characteristics to permit the suspension of multiple hangers through the use of the connector. The areas in which the connector may be used are not limited to the display of garments. It should be apparent that this connector has application in any display arrangement in which it is desired to employ two or more vertically offset hook suspended hangers. For example, the connector could be employed to suspend and space in vertical relationship a plurality of hook-supported carpet samples, for example. For uses involving heavier products, the invention can be made from thicker stock to give the connector greater strength. The connector also may be made wider. Further, the general shape of the connector may be varied. The primary requirement is that an opening be provided through which one hook may be passed and that a second strap-like opening be included for reception or attachment of the lower hanger and that the connector neither tear nor stretch under the expected loading.

As expressly intended, therefore, the above description should be considered as that of the preferred embodiment only. The true spirit and scope of the present invention will be determined by reference to the appended claims.

The embodiments of the present invention in which an exclusive property or privilege is claimed are as follows.

1. A detachable and reusable device for supporting one hook suspended garment hanger from another in a vertically spaced relationship, comprising:

an elongated strip of flexible sheet-like plastic material having tension sustaining characteristics, said strip including an opening adjacent one end defined by a slit extending transversely and longitudinally of said strip for receiving the hook of an upper hanger, said strip further including a pair of spaced parallel slits defining a strap spaced from the lateral edges of the strip and from the other end thereof for forming an attachment for the hook of a lower hanger, the lower, terminal portion of each said spaced slits extending outwardly and upwardly in a hook-like shape.

2. A device as defined in claim 1 wherein said opening at one is formed by an inverted generally U-shaped slit, said slit defining a flexible tab normally occupying said opening; said strap being flexible and displaceable from the plane of the strip to permit a hanger hook to be passed behind said strap and in front of said lateral edge portion of said strip.

3. A device as defined in claim 2 wherein said strip is of generally transparent material to reduce its visibility when in use.

* * * * *